US006056002A

United States Patent [19]

Morlok

[11] Patent Number: 6,056,002

[45] Date of Patent: May 2, 2000

[54] ASSEMBLING MODULE FOR SANITARY PLUMBING AND METHOD FOR MANUFACTURING SAME

[76] Inventor: Ulrich Morlok, Längenfeld 22, 89584 Ehingen, Germany

[21] Appl. No.: 09/057,930

[22] Filed: Apr. 9, 1998

Related U.S. Application Data

[63] Continuation of application No. PCT/EP96/03673, Aug. 21, 1996.

[30] Foreign Application Priority Data

Oct. 10, 1995 [DE] Germany ..... 195 37 743
Jul. 12, 1996 [DE] Germany ..... 296 12 197

[51] Int. Cl.[7] ..... F16L 55/18; F16L 59/16

[52] U.S. Cl. ..... 137/15; 137/594; 137/377; 248/300

[58] Field of Search ..... 285/45; 137/594, 137/377, 382, 360, 361, 15; 248/300

[56] References Cited

U.S. PATENT DOCUMENTS

| | | | |
|---|---|---|---|
| 3,741,428 | 6/1973 | Evjen et al. | 248/300 X |
| 3,921,449 | 11/1975 | Hauffe et al. . | |
| 4,441,684 | 4/1984 | Credle, Jr. | 248/300 X |
| 5,381,902 | 1/1995 | Dumser et al. | 137/377 X |

FOREIGN PATENT DOCUMENTS

| | | |
|---|---|---|
| 0431222A1 | 6/1991 | European Pat. Off. . |
| 2756163A1 | 6/1979 | Germany . |
| 8234277 | 9/1983 | Germany . |
| 9203601 | 10/1992 | Germany . |
| 9304188 | 9/1993 | Germany . |
| 9310126 | 1/1994 | Germany . |
| 9419330 | 3/1994 | Germany . |
| 9410742 | 12/1994 | Germany . |
| 4322696A1 | 1/1995 | Germany . |

OTHER PUBLICATIONS

European Patent Office, *Copy of International Search Report for Parent Application No. PCT/EP96/03673.*

*Primary Examiner*—Henry Bennett
*Assistant Examiner*—Joanne Y. Kim
*Attorney, Agent, or Firm*—Wood, Herron & Evans, L.L.P.

[57] ABSTRACT

An assembling module (10) for the sanitary plumbing of a building has one or several conduit portions (14, 16) which are tightly connected with a shut-off device (18) and a meter base (20) each. The conduit portions (14, 16) and the shut-off devices (18) as well as the meter bases (20) are arranged in a parallelepiped-shaped foamed encapsulation (12) which locates the foam-encapsulated parts in a three-dimensionally secure manner and simultaneously constitutes the outer surface of the assembling module (10). The foamed encapsulation (12) is moisture-repellent and has a density of a least 50 kg/m$^3$. At each end of the conduit portions (14, 16) a connection socket (22) is arranged which protrudes outwardly from the foamed encapsulation (12). At two opposite sides of the assembling module (10) one fixing element (26) each can be arranged within the foamed encapsulation (12), at which brackets (28, 30) are attached for mounting the assembling module (10). The assembling module (10) lends itself to an economic manufacture, easy installation and convenient tiling.

29 Claims, 2 Drawing Sheets

ASSEMBLING MODULE FOR SANITARY PLUMBING AND METHOD FOR MANUFACTURING SAME

Figure 1:
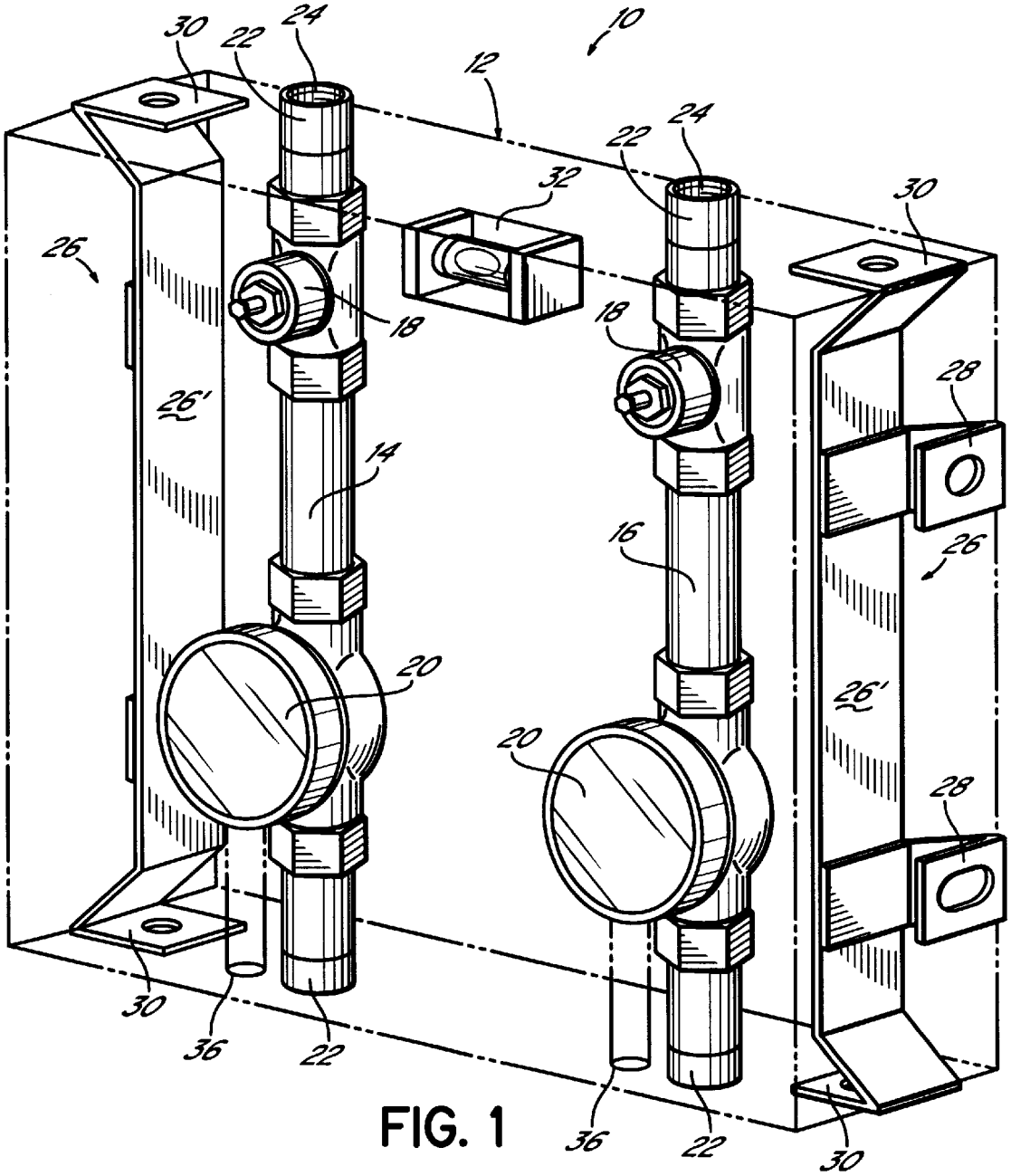

The present application is a continuation of applicant's PCT application PCT/EP96/03673 filed Aug. 21, 1996, currently pending, and claiming priority of German Patent No. 195 37 743.5 filed Oct. 10, 1995, and German Patent No. 296 12 197.5 filed Jul. 12, 1996.

The invention relates to an assembling module for sanitary plumbing and a method for manufacturing such an assembling module. In particular, the invention relates to an assembling module which comprises two conduit portions each including a shut-off device and a meter base which by means of the assembling module can be easily installed in a visually attractive and a functionally convincing manner.

Separate water meters for hot and cold water including an associated shut-off valve each are nowadays required in every rented flat in compliance with the requirements imposed by the legislation according to which a definite allocation of consumed water and energy amounts to individual flat units is requested. In order to enable a visually more attractive and a faster installation of two separate water meter/shut-off valve units, an assembling module has been proposed in DE 43 22 696 A1 which comprises a sheet metal housing into which two water meters and the two associated shut-off valves are pre-installed. The water meters and shut-off valves which are aligned relative to each other are attached by pipe clamps at the inside of the rear wall of the sheet metal housing. A bubble level is attached as an alignment aid at the front side of the sheet metal housing, and the interior of the sheet metal housing is filled with PU foam in order to reduce sound transmission. Although this known assembling module is a considerable improvement compared to the previously usual individual installation of the mentioned parts, its manufacture is relatively expensive and due to the associated costs is in contradiction with the aim of a general reduction of the building costs.

The invention is based on the object to provide an assembling module for the sanitary plumbing of a building, which can be employed as universally as possible and in particular for the previously mentioned purpose, which has superior operational characteristics, can be handled in a fool-proof manner and is therefore easy to install and yet can be manufactured economically in larger quantities.

According to the invention this object is solved by an assembling module with the features as defined in claim 1. Contrary to the assembling module known from DE 43 22 696 A1, the assembling module according to the invention dispenses with any housing. Instead, the assembling module according to the invention is formed by a parallelepiped-shaped foamed encapsulation of the required conduit portions as well as of the associated shut-off devices and water meter bases. The foamed encapsulation which simultaneously constitutes the outer surface of the assembling module is moisture repellent and has a density of at least 50 kg/m$^3$. This density is sufficient for the secure and reliable location of the previously mentioned parts relative to each other so that the desired three-dimensional arrangement of the individual parts relative to one another remains immovable within the normal stress conditions to which the assembling module is subjected also during installation. Due to the omission of a housing the assembling module according to the invention is lightweight but surprisingly rigid and moreover excellently sound-proof. It lends itself for an economic manufacture in large quantities, for example, by means of the manufacturing method defined in claim 14.

The density of the foamed encapsulation of the assembling module according to the invention is preferably higher than 50 kg/m$^3$, more preferably at least 80 kg/m$^3$ and most preferably between 90 kg/m$^3$ and 120 kg/m$^3$. Assembling modules according to the invention with a foamed encapsulation of such a density withstand even extreme stresses as can occur for example when an assembling module falls down. If a foamed encapsulation with a density of less than 50 kg/m$^3$ is to be employed then, according to an alternative embodiment of an assembling module according to the invention with at least two conduit portions, the reduced strength can be compensated by bracings between the two parallel conduit portions, for example, by two or three struts which extend transversely to the conduit portions and which form a stabilizing framework or skeleton, respectively, in the interior of the foamed encapsulation. With respect to impact or falling such an alternative embodiment of an assembling module according to the invention, however, is not as resistant as the embodiments provided with the higher density foamed encapsulation. In each case, a two-component PU foam is preferably used as the encapsulation foam material. Due to its slight roughness the surface of the foamed encapsulation presents an excellently suited tiling base upon which usual tile adhesives adhere very well.

The connection sockets which protrude from the assembling module according to the invention at both ends of each conduit portion are preferably formed as screw connections. Due to its inherent stability, the assembling module according to the invention easily withstands the torque loads to which it is subjected during connection to the sanitary plumbing without a change in position of the parts which are foam-encapsulated within. Moreover, screw connections offer the possibility to simply make-up inventive assembling modules for all standard applications in advance.

The top side of each shut-off device and each meter base of an assembling module according to the invention is freely accessible through corresponding preferably circular recesses in the foamed encapsulation so that the handle parts of the shut-off valves and/or the meter top parts can rapidly and easily be supplemented without necessitating preparatory work—except for the removal of the protective caps.

For the facilitated correct alignment of the assembling module according to the invention at the place of use, preferred versions include a bubble level which is embedded in the foamed encapsulation and which is visible at least from the front of the assembling module. If this bubble level is provided at the upper front edge of the foamed encapsulation it can be observed both from the front and from above.

In order to ensure that the assembling module according to the invention can be tiled in an optically satisfactory manner, the centres of the shut-off devices and the meter bases are arranged, as seen from above, according to a certain grid dimension, e.g. in a grid dimension of 153 mm. When using tiles with an edge length of 15 cm this last-mentioned grid dimension corresponds to the standard grid dimension and allows the placement of a square 15 cm tile exactly between the four corner points which result from two shut-off devices and two meter bases. It is understood that assembling modules according to the invention can easily be manufactured for other grid dimensions as well.

In order to enable the secure and easy mounting of the assembling module according to the invention on a wall or also on a surface-mounted installation system the foamed encapsulation of the preferred embodiment is provided at two opposite sides with a fixing element each at which brackets are attached. These fixing elements are not secured separately but are held in position by the rigid foam which surrounds them. The fixing elements are preferably of an essentially band-shaped or strip-shaped configuration and are formed as sheet metal parts or also as plastic material parts. Embodiments without fixing elements are held in position only by joining their connection sockets with the corresponding conduits.

In preferred embodiments of assembling modules according to the invention each fixing element comprises both brackets for attaching the assembling module to a wall located behind it, as well as brackets for attaching the assembling module at wall sections which are located laterally to it. The last mentioned brackets can also be used for attaching the assembling module to an upright wall construction which is part of usual surface-mounted installation systems. Each fixing element is advantageously designed as an integral component with the brackets and formed for example by a sheet metal punched part or a sheet metal formed part, respectively.

In one embodiment of an assembling module according to the invention the brackets of the fixing elements are arranged so as to be flush with the surface of the foamed encapsulation and can be tilted from the foamed encapsulation surface into a mounting position. Brackets which are not required are not tilted and therefore do not interfere with the mounting operation. According to a slightly modified embodiment two opposing brackets of each fixing element project from the surface of the foamed encapsulation by approx. the dimension of their material thickness, still extending parallel to the respective surface of the foamed encapsulation. It is also possible for all existing brackets to project from the surface in the described manner. The projecting brackets of such modified embodiments can be gripped more easily and be tilted or bent, respectively, into their mounting position. In addition, they offer benefits from a manufacturing point of view which will be discussed later in connection with the inventive manufacturing method.

Although the assembling module according to the invention has been and will be described with reference to an embodiment which comprises two shut-off valves and two water meter bases, it is understood that a plurality of modified assembling modules according to the invention can be manufactured easily for similar applications, all of which are based on the object to arrange a series of visible devices in a three-dimensionally defined manner with respect to one another. Instead of the described combination of water meters and shut-off valves other applications, for example, can necessitate the arrangement of merely a series of shut-off valves or of water meters in a visually attractive manner.

The assembling modules according to the invention are preferably manufactured in accordance with the following method: At first, the two conduit portions, for example (depending on the application, this may be several or only a single conduit portion), are tightly connected with the desired fittings, that is to say, in the case mainly described here, with one shut-off device and one water meter base. Unless connection sockets are not already attached to the fittings or to the meter bases, respectively, each end of the conduit portions is tightly connected with a connection socket whose length is such that it projects from the finished assembling module. The prepared conduit portions connected with the desired fittings are then placed into a parallelepiped-shaped foaming mould to which holders are associated which ensure a parallel and a desired three-dimensionally precisely defined arrangement of the conduit portions. If the finished assembling module is to have fixing elements, said fixing elements with the brackets attached thereto are subsequently placed into the foaming mould. The foaming mould can then be closed. Forming parts which may be part of the foaming mould and which protrude into the foaming cavity prevent the surfaces of the shut-off devices and the meter bases from subsequently being closed off by the foam. Now, a previously determined defined quantity of moisture-repellent curing foam is introduced into the foaming cavity, and the introduced foam is allowed to cure. After curing the foaming mould can be opened and the finished assembling module removed. The outer surface of the obtained foamed encapsulation corresponds to the inner surface of the foaming mould and is normally slightly rough in order to achieve a better adherence of material to be applied to the assembling module. If desired, however, the surface can also be completely smooth.

According to a preferred embodiment of the manufacturing method according to the invention, the desired fittings, i.e. in this case the shut-off devices and the water meter bases, are tightly connected with the corresponding conduit portions by means of an adhesive. In particular, a curing adhesive is used which is applied to a screw thread prior to the screw connection of each conduit portion with a meter base, for example, and which, after curing, ensures that this screw connection is unable to loosen subsequently and, as a result, to become untight. Alternatively, the joints can also be sealed with hemp or can be soldered.

As already mentioned elsewhere and according to a preferred embodiment of the assembling module according to the invention, two opposite brackets of each fixing element are designed in such a manner that they extend parallel to the corresponding foaming surface, but project from the foaming surface by approximately the dimension of their material thickness. Such an embodiment is advantageous with respect to the manufacturing method according to the invention in that each fixing element can be located by these two brackets in the foaming mould by the brackets arranged at opposite ends of the fixing elements engaging in corresponding recesses of the foaming mould inner wall, the depth of which corresponds at least approximately to the material thickness of the brackets. Thus, the fixing elements are arranged in the foaming mould in a defined manner and cannot be displaced from their position even by the introduced foam. A further advantage of such an embodiment or such a manufacturing method modified in this way is that the brackets which protrude slightly from the foamed encapsulation surface can be gripped more easily to enable them to be tilted or bent, respectively, into their mounting position.

Depending on the foam employed, it may be beneficial to heat the foaming mould during the foaming process and/or to cool it during the curing process. The foam employed is preferably a two-component PU foam. When such a foam is used, the foam-encapsulated assembling module can be removed from the foaming mould after only approx. 15 to 20 minutes; the time required for complete curing of the foam is approx. 30 to 40 minutes.

The already mentioned forming parts protruding into the foaming cavity advantageously have a slightly larger diameter than protective caps which are later, i.e. after removal of the assembling module, placed into the recesses formed by the forming parts in the foaming surface. This ensures that the protective caps can be fitted easily and that finishing of the assembling module with handle parts or meter top parts, respectively, can be effected later without reworking the foamed encapsulation.

Figure 2:
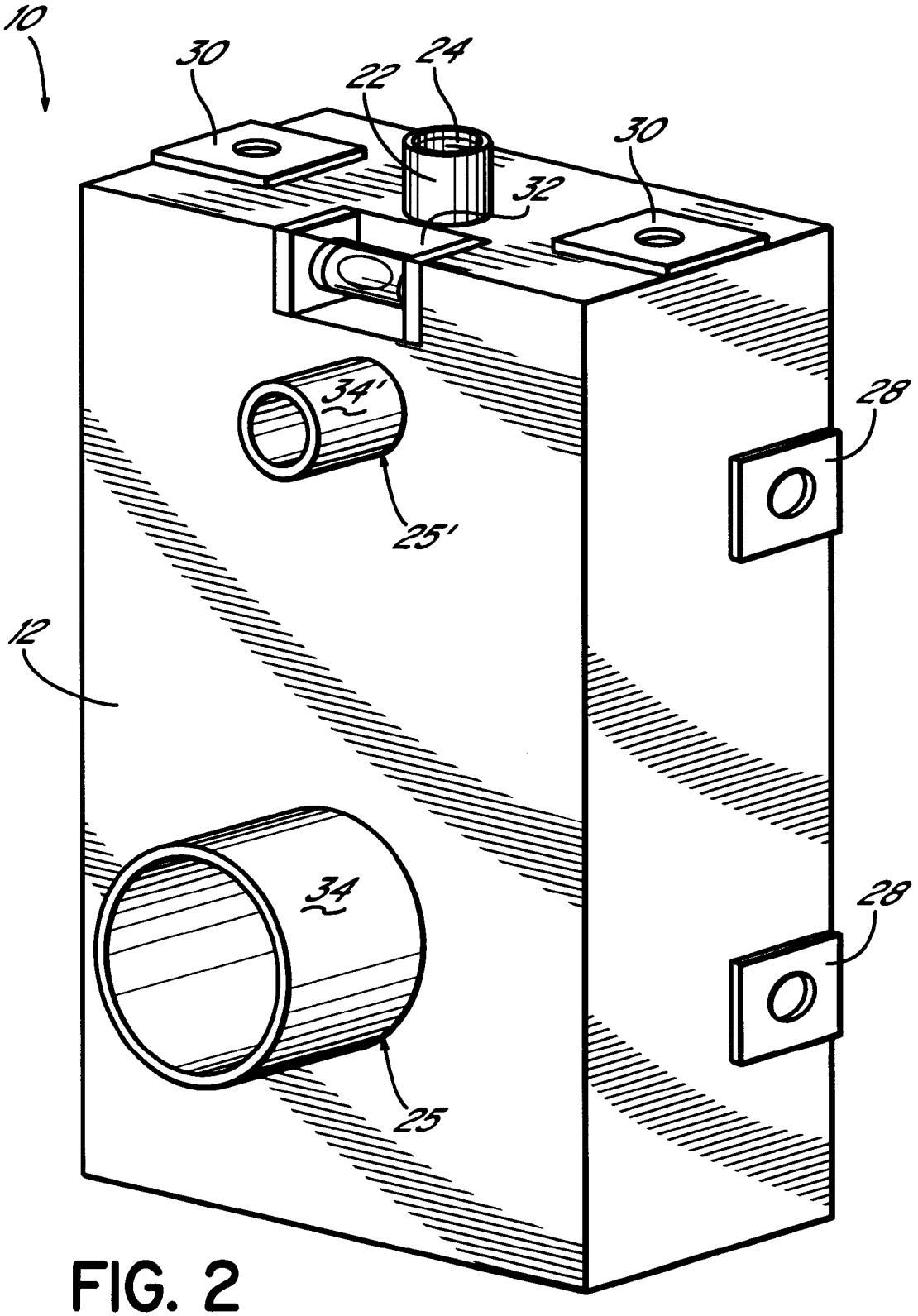

Two prefered embodiments of an assembling module according to the invention will be explained in more detail in the following with reference to the figures in which:

FIG. 1 shows a perspective view of a first embodiment of an assembling module according to the invention with two conduit portions in which a shut-off device and a water meter base each are arranged; and FIG. 2 shows a perspective view of a second embodiment of an assembling module according to the invention with only one conduit portion.

FIG. 1 shows an assembling module 10 whose outer shape is essentially determined by a parallelepiped-shaped foamed encapsulation 12. The border lines of the parallelepiped-shaped foamed encapsulation 12 are shown in FIG. 1 by dashed lines, and the foam is shown transparent for better visibility of the interior of the assembling module 10. It is understood, however, that the foam employed is, in reality, not transparent.

A first conduit portion 14 and a second conduit portion 16, which extends parallel to same, are arranged within the foamed encapsulation 12. Each conduit portion 14, 16 extends parallel to the rear side of the assembling module 10 and comprises a shut-off device 18, as well as a meter base 20 which are connected in a tight manner with the associated conduit portion 14 or 16, respectively. The shut-off devices 18 as well as the meter bases 20 are also located within the foamed encapsulation 12. The ends of each conduit portion 14, 16 are formed by connection sockets 22 which are also connected in a tight manner with a shut-off device 18 or a meter base 20, respectively, and which protrude outwardly from the foamed encapsulation 12. The connection sockets 22 are provided with a female thread 24 each, i.e. they are designed as screw connections. By selecting suitable connection sockets 22, the assembling module 10 can be easily integrated into all standard sanitary plumbing systems. In the shown embodiments, the joint between the shut-off device 18 or the meter base 20, respectively, and the associated conduit portion 14 or 16, respectively, are designed as screw connections.

The two conduit portions 14 and 16 are aligned within the foamed encapsulation 12 in such a manner that both shut-off devices 18 and both meter bases 20 are each arranged in the same plane and at the same height with respect to the vertical extension of the assembling module 10. Moreover, the shut-off devices 18 and the meter bases 20 are arranged within the foamed encapsulation 12 in such a manner that they can be completed from the front side of the assembling module 10, i.e. that a handle part can be fitted onto each shut-off device 18 and a meter top part onto each meter base 20. For this purpose, a corresponding recess 25, 25' (see FIG. 2) is located in the foamed encapsulation 12 above each shut-off device 18 and above each meter base 20, which is produced by suitable forming parts during the manufacture of the foamed encapsulation 12. Relative to the plan view of the assembling module 10, the centers of the shut-off devices 18 as well as of the meter bases 20 are arranged in such a manner that a grid dimension A is obtained which, in the example shown, has a value of 153 mm. In this manner, it is possible to place exactly one tile with an edge length of 15 cm onto the surface of the assembling module 10 defined by the four centers. It goes without saying that the grid dimension A has another value for other tile sizes.

In the vicinity of the r.h. and l.h. edge of the assembling module 10 in FIG. 1, one fixing element 26 each is arranged within the foamed encapsulation 12 and held by same and is provided with brackets 28 and 30 for mounting the assembling module 10 at the place of use. To ensure that the fixing elements 26 are anchored in a sufficiently stable manner in the foamed encapsulation 12, its band-shaped body 26', from which the brackets 28 and 30 extend, is arranged a few centimeters from the associated side surface of the assembling module 10 within the foamed encapsulation 12. As can be seen from the figures, the brackets 28 and 30 are arranged flush with the surface of the foamed encapsulation 12 and, from the position shown, can be brought into a mounting position by tilting about 90°. If the fixing element 26 is a sheet metal strip as shown in the illustrated example, the brackets 28, 30 are tilted by simply bending same.

Each fixing element 26 has two brackets 28 and two brackets 30 of which the brackets 28 are intended for mounting the assembling module 10 to a wall arranged behind it, while the brackets 30 are intended for mounting the assembling module 10 to laterally arranged wall sections, but, in particular, are intended for mounting to an upright wall construction as used for surface-mounted installation systems. The distance between the two brackets 30 of a fixing element 26, or the distance between the holes in the backets, respectively, is advantageously selected such that this distance corresponds to the grid dimension of the surface-mounted installation system. In the event that the assembling module 10 is installed in a concealed manner, then only the brackets 28 are usually employed, whereas in the case of a surface-mounted installation system only the brackets 30 are normally used.

In the illustrated embodiment, the material of the foamed encapsulation 12 is a moisture-repellent two-component PU foam which, in the cured condition, has a density of between 90 kg/m$^3$ and 120 kg/m$^3$. A foam with a density such as this ensures an extremely stable packaging of the entire assembling module 10 and can, in particular, readily withstand the stresses which occur when connecting the assembling module 10 to a sanitary plumbing system. According to an alternative embodiment of the assembling module (10) having at least two conduit portions (14, 16), if the foamed encapsulation (12) has a density of less than 50 kg/m$^3$, then the strength of the foamed encapsulation (12) can be increased with bracings (40) between the two parallel conduit portions (14, 16), e.g., by two or three struts which extend transversely to the conduit portions (14, 16) so as to form a stabilizing framework or skeleton within the foamed encapsulation (12).

In order to facilitate the correct alignment of the assembling module 10, a bubble level 32 is embedded at the front in the foamed encapsulation at the upper edge of the foamed encapsulation 12 so that a separate spirit level is no longer necessary. In the installed condition, the exposed surface of the foamed encapsulation 12, which may have a smooth or slightly rough finish, constitutes a base which is excellently suited for tiling.

FIG. 2 shows a second embodiment of an assembling module 10 which differs from the previously described first embodiment in that only one conduit portion 14 and, correspondingly, only one shut-off device 18 and one meter base 20 are provided. The second embodiment otherwise corresponds to the first. Assembling modules according to the second embodiment are employed, for example, in instances where only the measurement of hot water consumption is required. In addition, FIG. 2 shows two protective caps 34, 34' which are placed into the recesses 25, 25' in order to protect the as yet not completed shut-off device or meter fitting, respectively, during shipping.

Regardless of the configuration of the assembling module 10 with one, two or a plurality of conduit portions 14, 16, the foamed encapsulation 12 advantageously has one or several ducts 36 (see FIG. 1) which extend from the outer surface of the foamed encapsulation 12 to the meter bases 20. Electrical cables can be routed through said ducts, which, where necessary, permit remote meter reading if the meters are equipped with a pulse generator. The ducts 36 can be created by corresponding forming parts during the foaming process; however, they can also be subsequently drilled or cut out without difficulty.

What is claimed is:

1. An assembling module (10) for the sanitary plumbing of a building, comprising at least a first conduit portion (14) both ends of which have a connection socket each (22) protruding from the assembling module, at least a shut-off device (18) or a meter base (20) being provided at mutually corresponding positions in each conduit portion (14), a one-piece parallelepiped-shaped foam encapsulation (12) which encloses each conduit portion (14), each shut-off device (18) and each meter base (20) and simultaneously constitutes the exterior surface of the assembling module (10), and which is made from a moisture-repellent, cured and rigid foam having a density such that the foam-encapsulated parts are securely located within the encapsulation (12) and their three-dimensional position with respect to each other is maintained even under load.

2. The assembling module as claimed in claim 1, wherein one shut-off device (18) and one meter base (20) is provided at mutually corresponding positions in each conduit portion (14).

3. The assembling module as claimed in claim 1, comprising at least two conduit portions (14, 16) extending at a distance from and parallel to each other, wherein at least two bracings (40) are provided which are attached to each of the conduit portions (14, 16) and extend transversely between conduit portions (14, 16) within the foamed encapsulation (12) to form a reinforcing structure.

4. The assembling module as claimed in claim 1, wherein the density of the foamed encapsulation (12) is at least about 50 $kg/m^3$.

5. The assembling module as claimed in claim 4, wherein the density of the foamed encapsulation (12) is in the range of about 90 $kg/m^3$ to about 120 $kg/m^3$.

6. The assembling module as claimed in claim 1, wherein the connection sockets (22) are formed as screw connections.

7. The assembling module as claimed in claim 1, wherein the top side of each shut-off device (18) and each meter base (20) is freely accessible through corresponding recesses in the foamed encapsulation (12).

8. The assembling module as claimed in claim 7, wherein the recesses in the foamed encapsulation (12) are circular.

9. The assembling module as claimed in claim 1, wherein a bubble level (32) is embedded into the foamed encapsulation (12), which is visible at least from the front of the assembling module (10) and serves as an aligning aid.

10. The assembling module as claimed in claim 1, wherein at least one conduit portion is provided which extends at a distance from and parallel to the first conduit portion (14).

11. The assembling module as claimed in claim 1, wherein with respect to the top plan view of the assembling module the centers of the shut-off devices (18) and the meter bases (20) are arranged in a grid dimension which is matched to a wall tiling.

12. The assembling module as claimed in claim 11, wherein the grid dimension is 153 mm.

13. The assembling module as claimed in claim 1, wherein the foamed encapsulation (12) includes one fixing element (26) each on at least two opposite sides, at which brackets (28, 30) for mounting the assembling module are attached.

14. The assembling module as claimed in claim 13, wherein each fixing element (26) comprises brackets (28) for attaching the assembling module to a wall located behind it, as well as brackets (30) for attaching the assembling module at wall sections which are located laterally to it or at a surface-mounted installation system, respectively.

15. The assembling module as claimed in claim 13, wherein each fixing element (26) is designed as an integral component with the brackets (28, 30).

16. The assembling module as claimed in claim 13, wherein the brackets (28, 30) are arranged flush with the surface of the foamed encapsulation (12) and are tiltable from the foamed encapsulation surface into a mounting position.

17. The assembling module as claimed in claim 13, wherein two opposite brackets (30) of each fixing element (26) protrude from the foamed encapsulation surface by approximately the dimension of their material thickness and are tiltable into a mounting position.

18. The assembling module as claimed in claim 13, wherein each fixing element (26) has an essentially band-shaped body (26').

19. The assembling module as claimed in claim 18, wherein each fixing element (26) is one of sheet metal and plastic material.

20. A method for manufacturing an assembling module (10), comprising the steps of:

tightly connecting at least one of a shut-off device (18) and a meter base (20) each with at least one associated conduit portion (14, 16);

placing the conduit portions (14, 16) into a parallelepiped-shaped foaming mould with holders which ensure a parallel and a three-dimensionally precisely defined arrangement of each conduit portion (14, 16) relative to the outer surfaces of the assembling module;

closing the foaming mould, whereby forming parts which protrude into the foaming cavity formed thereby prevent the surfaces of the shut-off devices (18) and the meter bases (20) from closed off by the foam;

introducing moisture-repellent curing foam into the foaming cavity to form a one-piece parallelepiped-shaped foamed encapsulation (12) which encloses each conduit portion (14, 16) each shut-off device (18) and each meter base (20) and simultaneously constitutes the exterior surface of the assembling module (10);

allowing the introduced foam to cure to form a rigid foam having a density such that the foam-encapsulated parts are securely located within the encapsulation (12) and their three-dimensional position with respect to each other is maintained even under load; and opening the foaming mould and removing the finished assembling module (10).

21. The method as claimed in claim 20, wherein the shut-off devices (18) and the meter bases (20) are tightly connected with the corresponding conduit portions (14, 16) by using an adhesive.

22. The method as claimed in claim 20, wherein the foaming mould is at least one of heated during the foaming process and cooled during the curing process.

23. The method as claimed in claim 20, wherein the forming parts protruding into the foaming cavity have a larger diameter than protective caps which, after removal of the assembling module, are placed into the recesses formed by the forming parts in the surface of the finished assembling module.

24. The method as claimed in claim 20, wherein the introduced foam is a two-component PU foam.

25. The method as claimed in claim 24, wherein the assembling module (10) can be removed from the foaming mould after approximately 15 to 20 minutes.

26. The method as claimed in claim 20, wherein fixing elements (26) comprising brackets (28, 30) are placed into the opened foaming mould before introducing the foam.

27. The method as claimed in claim 26, wherein each fixing element (26) is located in the foaming mould by two brackets (30) attached to it which are arranged at opposite ends of the fixing element and which engage into corresponding recesses in the foaming mould inner wall, the depth of which corresponds at least approximately to the material thickness of the brackets (30).

28. The method as claimed in claim 20 wherein several conduit portions (14, 16) are provided in parallel arrangement one with each other within the parallel piped-shaped foaming mould.

29. The method as claimed in claim 20 wherein enough moisture-repellant curing foam is introduced into the foaming cavity in order to fill the foaming cavity.

* * * * *